United States Patent [19]

Marchetti

[11] Patent Number: 4,907,770

[45] Date of Patent: Mar. 13, 1990

[54] TUCK-UP FOOT FOR FURNITURE

[75] Inventor: Sergio Marchetti, Rho, Italy

[73] Assignee: Camar S.p.A., Figino Serenza, Italy

[21] Appl. No.: 267,998

[22] Filed: Nov. 7, 1988

[30] Foreign Application Priority Data

Nov. 13, 1987 [IT] Italy ..... 22641 A/87

[51] Int. Cl.[4] ..... F16M 11/38

[52] U.S. Cl. ..... 248/188.6; 248/188.8; 403/102

[58] Field of Search ..... 248/188.6, 188.8, 188.1, 248/165, 166, 167, 168, 436, 439, 170, 171, 223.4, 224.4; 5/314 R, 314 B; 108/129; 403/102, 116

[56] References Cited

U.S. PATENT DOCUMENTS

| | | | |
|---|---|---|---|
| 2,838,353 | 6/1958 | Emmert . | |
| 2,868,602 | 1/1959 | Drezner | 248/188.8 X |
| 3,310,268 | 3/1967 | Kramer | 248/439 X |
| 3,396,928 | 8/1968 | Lay | 248/188.6 |
| 3,606,450 | 9/1971 | Sedgwick | 108/129 X |
| 4,135,691 | 1/1979 | Wiesmann | 248/188.6 |
| 4,144,822 | 3/1979 | Roberts et al. | 108/129 |
| 4,735,392 | 4/1988 | Farmer | 248/188.6 X |

FOREIGN PATENT DOCUMENTS

| | | |
|---|---|---|
| 0066335 | 5/1982 | European Pat. Off. . |
| 84/02454 | 7/1984 | PCT Int'l Appl. . |
| 2049410 | 3/1980 | United Kingdom . |

*Primary Examiner*—Ramon O. Ramirez

*Attorney, Agent, or Firm*—Hedman, Gibson, Costigan & Hoare

[57] ABSTRACT

A foot for furniture, in particular kitchen furniture, is restrained to a fixing device on the underside of a piece of furniture in a manner that permits it to be tucked upwards from a vertical operative position to a substantially horizontal inoperative position adjacent to the said underside, wherein the fixing device protects both the foot and the underside of the piece of furniture. Between the foot and the fixing device means are provided for disengageably locking the former stably in the vertical operative position.

The said locking means preferably consists of at least a coupling with grooved profiles.

6 Claims, 2 Drawing Sheets

TUCK-UP FOOT FOR FURNITURE

The present invention relates to a tuck-up foot for furniture, especially but not exclusively kitchen furniture.

As is known to persons with ordinary skill in the art, it is sometimes necessary and would nearly always be highly desirable to transport a piece of furniture with the feet already fixed to it. But the presence of the feet appreciably increases the space taken up by the piece of furniture during transportation and, in addition, it is easy for the feet to be broken if the piece of furniture is not handled with all due care during the various moving operations.

On the other hand, mounting the feet where the piece of furniture is to be installed is a lengthy, costly and not very dependable operation. In addition, feet supplied separately from the furniture not infrequently fail to arrive.

The overall object of the present invention is therefore to obviate the aforesaid drawbacks by embodying a foot for furniture able to be fixed to the piece of furniture in a way that does not appreciably increase its bulk dimensions, in the interests both of ready transportation and of rapid mounting.

To achieve the said object, the present invention embodies a foot for furniture characterized in that it comprises, in combination: a device for stably fixing it to the underside of the piece of furniture, to which device the foot is restrained in an up-tuckable manner from a first vertical operative position to a second substantially horizontal inoperative position in contact with the said underside, there being provided between the said foot and the said fixing device disengageable locking means adapted to lock the foot stably to the device in the said vertical position.

The said locking means preferably consist of one or more couplings with grooved profiles in which a male portion is formed at one end of the foot and/or along one of its generating lines and a female portion is incorporated in the device for fixing the foot to the underside of the piece of furniture.

The structural and functional characteristics of the invention, and its advantages over the known art, will become more apparent from an examination of the following description, referred to the appended drawings which show an example of a foot embodied according to the innovative principles of the invention. In the drawings.

Figure 1:
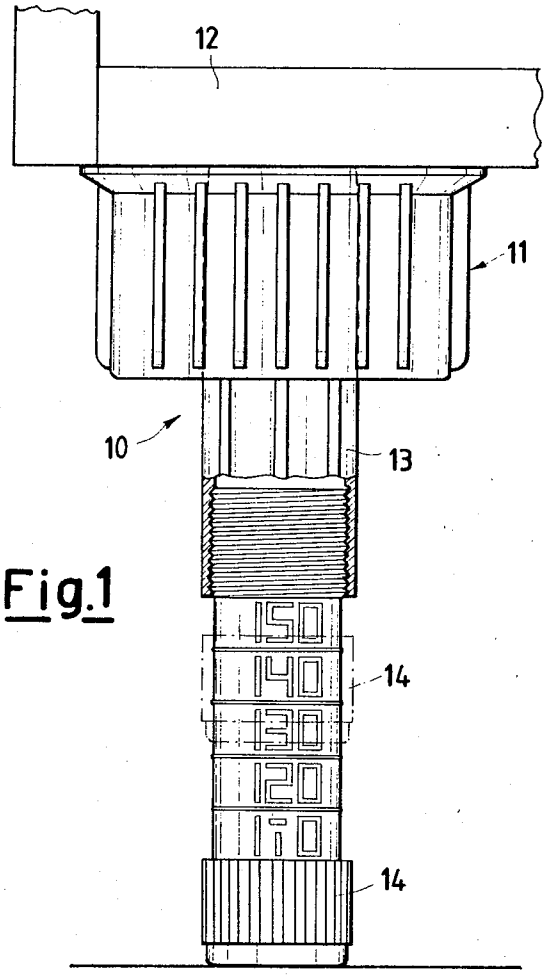
FIG. 1 is an elevational view illustrating the said foot in the operative position.
Figure 3:
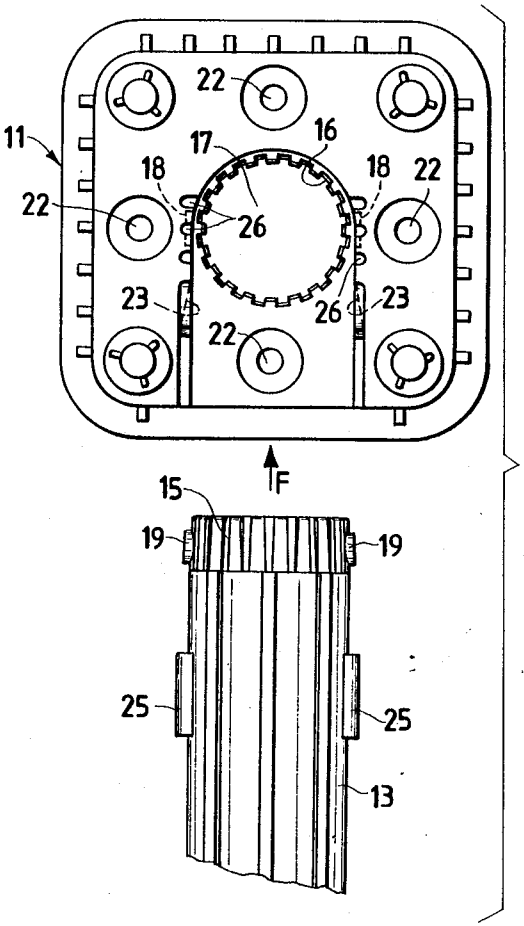
FIG. 3 is an enlarged view illustrating the phase of coupling the foot to the fixing device.
Figure 4:
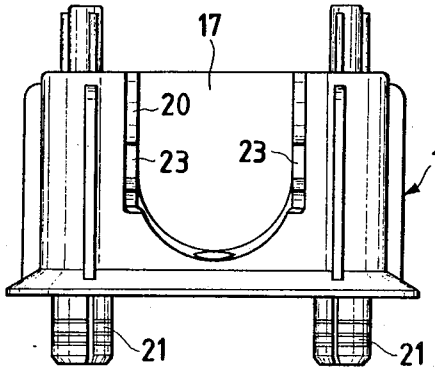
FIG. 4 is a particular illustrating the device for fixing the foot to the underside of the piece of furniture, taken through the arrow F of FIG. 3.
Figure 5:
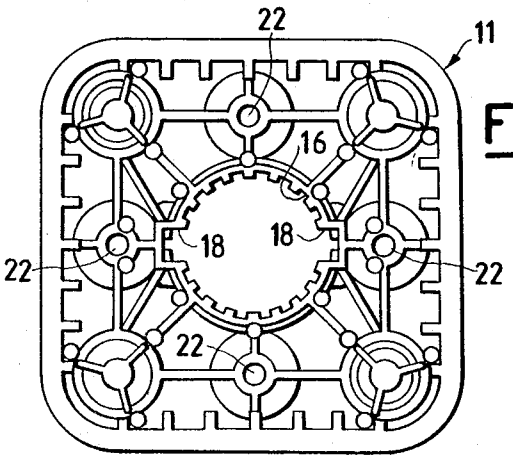
FIG. 5 is a bottom plan view of the same fixing device as shown in FIG. 4.

With reference to the drawings, the foot in question is indicated overall by 10, and is combined with a fixing device 11 which serves to apply it stably to the underside 12 of a piece of furniture (FIG. 1). The foot 10 can be of any type well-known to persons with ordinary skill in the art consisting of a tubular element 13, made of metal or plastics material, onto the end of which that is intended to rest on the floor there is screwed a level-device 14 for stabilizing the piece of furniture and placing it in plane; on the threaded tang of the level-device 14 provision can be made for numerals and/or other reference means, and also stop means, able to indicate the exact degree to which it has been extracted from the tubular element 13.

At the end of the tubular element 13 opposite the level-device 14 there is formed a male portion 15 of a coupling with grooved profiles, of which the female portion 16 is secured within a first partially cylindrical seat 17 of the device 11 which, as the drawings clearly show, is box-shaped. The partially cylindrical seat 17 is a through-seat and also features a pair of diametrically opposed grooves 18 in which respective pins 19 formed in the tubular element 13 can translate and rotate. The seat 17 opens into a second seat 20, substantially semi-cylindrical, lying in the same plane as the first seat but disposed perpendicularly to it.

The box-shaped device 11 can be fixed to the underside of the piece of furniture by, for example, a series of expanding plugs 21 incorporated in it, of the type described and illustrated in Italian patent application 21870 A/81 of the same Applicant, filed on May 21, 1981, and/or by simple screws passing through bores 22 already made for the purpose in the device 11.

The foot 10 is applied to the fixing device 11 through the seat 20, exploiting the relative yieldability of the materials, by latching engaging the pins 19 into the grooves 18, and also a pair of slanting surface entryways 23 provided on the opposed walls of the seat 20.

Figure 2:
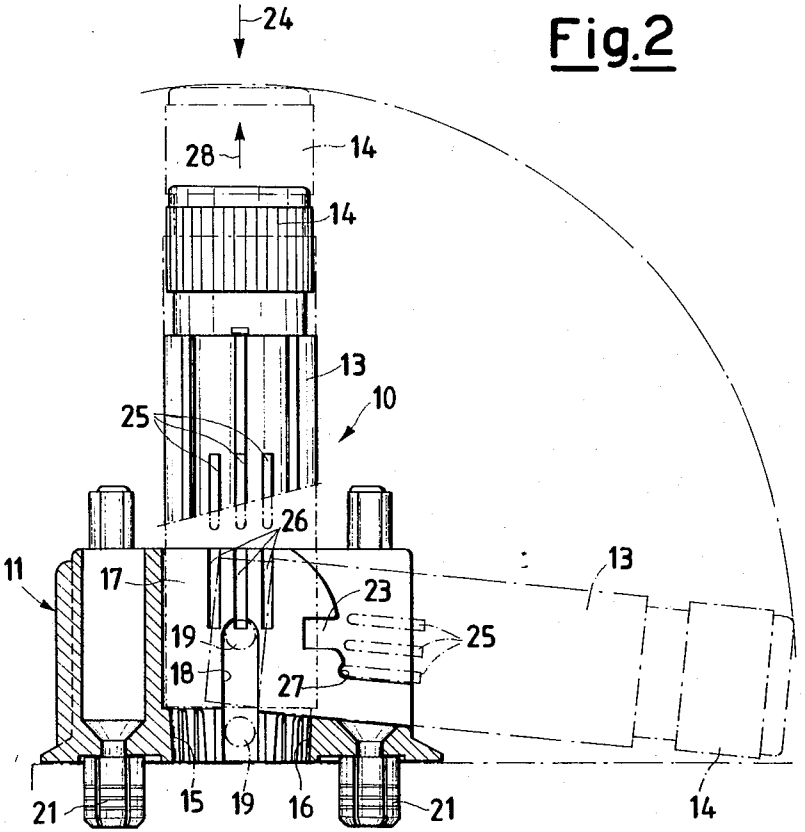
FIG. 2 is a partially cutaway elevational view in which the dashed and dotted line illustrates the foot in its inoperative tucked-up position.

In this way the foot 10 can be moved from the substantially horizontal inoperative position in contact with the underside of the piece of furniture, which position is shown by a dashed and dotted line in FIG. 2, to the vertical operative position by means of a simple rotation about the pins 19 followed by a translation in the direction indicated by the arrow 24, until the grooved profiles 15, 16 are brought into forced reciprocal engagement.

With the grooved profiles 15, 16 there preferably cooperates a second coupling with grooved profiles 25, 26 on the tubular element 13 and on the walls of the seat respectively. In addition, at least one pair of the profiles 25, diametrically opposed, engages corresponding slots 27 on the seat 20, in order to maintain the foot stably in the horizontal inoperative position adjacent to the underside of the piece of furniture.

It will also be clear that, if necessary, for example for a subsequent transportation, the foot 10 can be tucked-up into the inoperative position by performing the reverse operation of disengaging the aforesaid grooved profiles by translating the foot in the direction shown by the arrow 28 and by subsequently rotating it about the pins 19 to the position shown by the dashed and dotted line.

All the foregoing evidences the embodiment of a tuck-up foot which is structurally relatively straightforward and economical and very easy to use without any possibility of error and which attains the objects mentioned in the introductory part of this specification, and in which the pins 19 are, when the foot 10 is in the vertical operative position, almost wholly relieved of stress, which is borne by the grooved profile couplings, by the broad support of the skirt of the tubular element 13 against the complementary seat 17 of the device 11, and by the top of the foot itself, which rests against the underside 12 of the piece of furniture, as is clearly shown in FIG. 1.

In this connection it is noteworthy that, if the operation of engaging the tubular element 13 within the complementary seat 17 is not complete, the weight of the loaded table will itself automatically take the tubular element 13 itself into the optimal position with its top against the underside 12.

A further advantage of the foot for furniture according to the invention lies in the fact that the couplings with grooved profiles are interspaced so as to act on the marginal areas (upper and lower edges) of the box-shaped fixing device, thus ensuring a perfectly stable coupling between the parts.

In addition, the box-shaped of the fixing device 11 simultaneously assures adequate protection both of the tucked-up foot and of the underside of the piece of furniture, with the possibility such shape affords of sliding the piece of furniture itself on the device 11.

Lastly, it is worthy of note that, when the device tucked-up in the position shown by the dashed and dotted line in FIG. 2, the whole takes on a configuration such that the fixing device 11 can readily be applied to the underside of the piece of furniture by bringing, using a suitable means, pressure to bear on its topside.

What is claimed:

1. A foot for furniture comprising:

(a) a device for stably fixing to the underside of the furniture the foot wherein said device restrains the foot in a first vertical position to support the furniture or in a second substantially horizontal position adjacent to the underside of the furniture for storage;

(b) a disengageable locking means of said device for stably locking said foot in said first vertical position wherein said locking means includes a first coupling with grooved profiles comprising a male portion formed at the top of said foot and a female portion forming part of a seat for said foot in said device; and (c) a pair of diametrically opposed grooves in said seat in which respective pins of the foot latchingly engage to provide rotational and translational movement of the foot.

2. The foot of claim 1 wherein respective sloped surface entryways cooperate with said pins of said foot in said seat for providing said latching engagement.

3. The foot of claim 1 wherein a second coupling cooperates with said first coupling and said second coupling includes grooved profiles, a male portion of which is formed in an intermediate area of the foot and a female portion is formed in said seat for stably maintaining the foot in said second substantially horizontal position adjacent to the underside of the furniture.

4. The foot of claim 3 wherein at least two diametrically opposed profiles of said male portion of said second coupling latchingly engage slots provided in said seat for stably maintaining the foot in said second substantially horizontal position adjacent to the underside of the furniture for storage.

5. The foot of claim 1 wherein said seat comprises two substantially semi-cylindrical portions, a first seat and a second seat, wherein said first seat lies in said second seat and said second seat lies in the same plane as said first seat but disposed perpendicularly to said first seat for stably maintaining the foot in either said vertical or said substantially horizontal position.

6. The foot of claim 1 wherein the furniture rests directly upon the top of the foot when the foot is in its said vertical position.

* * * * *